US005832638A

United States Patent [19]

Watts

[11] Patent Number: 5,832,638

[45] Date of Patent: Nov. 10, 1998

[54] LOW DRAFT HIGH YIELD BUCKET SYSTEM FOR DRAGLINES

[75] Inventor: Cleal T. Watts, Dallas, Tex.

[73] Assignee: Cleal Watts, Dallas, Tex.

[21] Appl. No.: 631,247

[22] Filed: Jul. 1, 1996

[51] Int. Cl.[6] ..... E02F 3/46

[52] U.S. Cl. ..... 37/396; 37/358; 37/444

[58] Field of Search ..... 32/195, 396, 397, 32/398, 399, 444; 299/18; 166/117.5, 271, 272; 37/900, 903

[56] References Cited

U.S. PATENT DOCUMENTS

| | | | |
|---|---|---|---|
| 1,242,320 | 1/1917 | Burkett | 37/396 |
| 2,200,315 | 5/1940 | Weimer | 37/396 |
| 2,249,070 | 7/1941 | Weimer | 37/396 |
| 2,334,460 | 11/1943 | Weimer | 37/396 |
| 4,944,102 | 7/1990 | Behlendorf et al. | 37/396 X |
| 5,307,571 | 5/1994 | Behlendorf et al. | 37/396 |
| 5,343,641 | 9/1994 | Gregory | 37/397 X |
| 5,575,092 | 11/1996 | Smit | 37/397 X |

*Primary Examiner*—Terry Lee Melius
*Assistant Examiner*—Robert Pezzuto

[57] ABSTRACT

A low draft, high yield, dragline bucket system that has about half the weight of current art. It has a low wide configuration with special highly efficient ground engaging, loading and dumping qualities. The strength, cube accomplishment, simplicity, and unit weight combine to compound efficiencies up to 150% of former buckets. This also compounds the ability of the dragline's scope while reducing its specifications and increasing its capacity. A special precise tilt back and hold and rigging system further increases the bucket capacity and further increases its operating range.

3 Claims, 8 Drawing Sheets

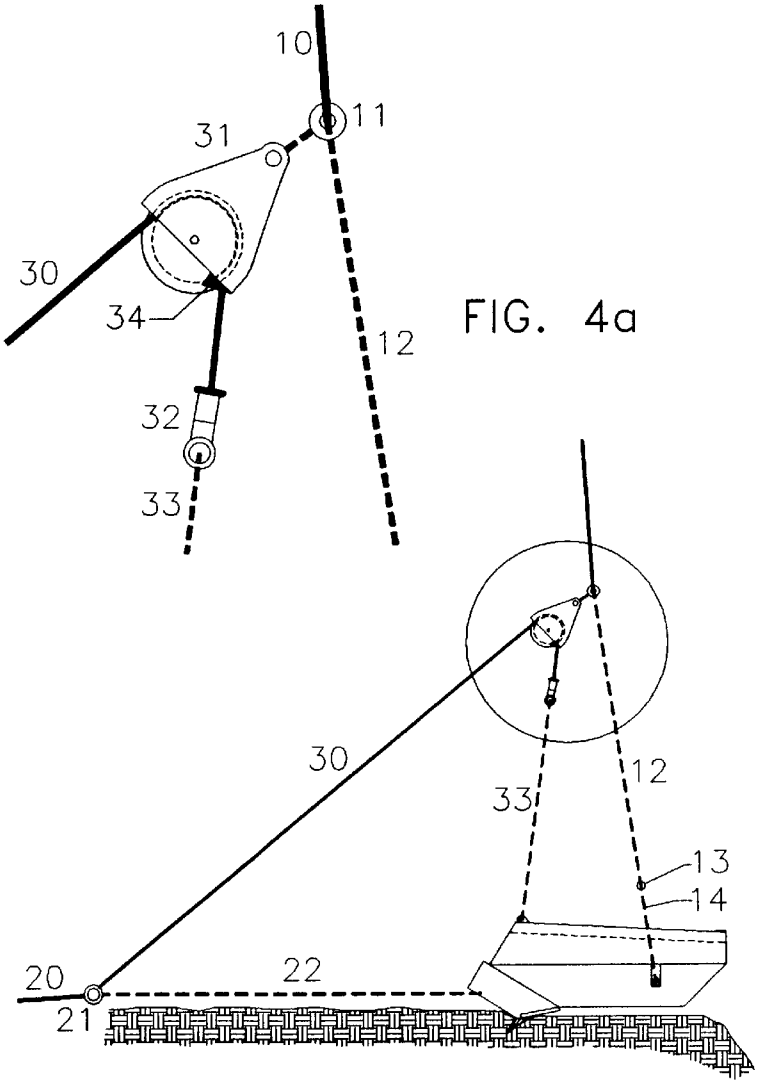
FIG. 4a
FIG. 4
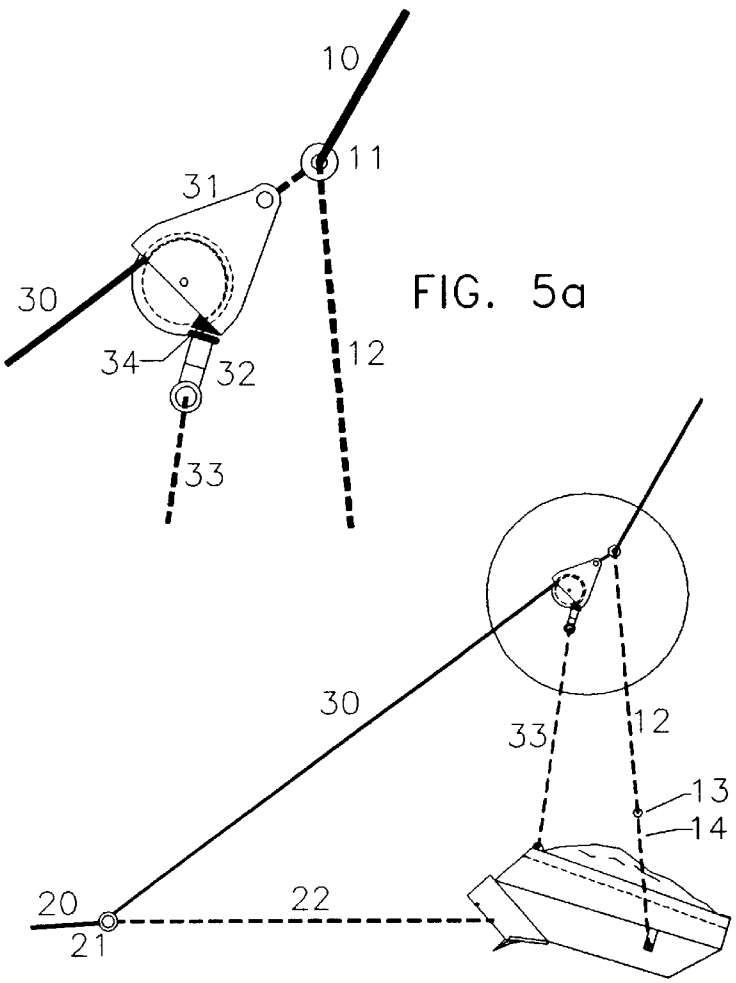
FIG. 5a
FIG. 5

LOW DRAFT HIGH YIELD BUCKET SYSTEM FOR DRAGLINES

BACKGROUND FIELD OF INVENTION

This invention relates to a dragline bucket shape, special structure, rigging and tilt back system whose light weight, high strength, easy loading, and good dumping qualities provide up to 150% production of dragline with less operating costs.

BACKGROUND—DISCUSSION OF PRIOR ART

Prior art dragline buckets are heavy and have many appurtenances such as arches, upper braces, heavy top rims, and rigid structures, as shown in Behlendorf et al U.S. Pat. No. 5,307,571, May 3, 1994 describes. Due to their tall and narrow baskets, the buckets are heavier and required much more draft to load and they often dump more slowly and randomly.

A tilt back system is shown Page U.S. Pat. No. 3,247,607, Apr. 26, 1966, later known as "The Miracle Hitch". This system was effective, but heavy and complicated with much extra rigging. Even with this tilt back help, the lack of smooth pendulous drag release forces, the bucket with a load, has tendencies of a helical trajectory flight to the dump, rather than a direct trajectory. The helical trajectory flight requires considerably more swing and stopswing power than a direct trajectory for the bucket flight to the dump.

Weimer patent U.S. Pat. No. 2,096,773 Oct. 26, 1937, shows a bucket having flaring walls which supposedly increase the load carrying capacity of the bucket without increasing its weight. Also Weimer claims his bucket's shape, offers greater resistance to deformation of the side walls, fills more readily due to lesser side friction, and carries greater proportionate heaped or overloads than the conventional buckets having vertical side walls and the same rated capacity.

However, Weimer's bucket lacks approximately 50% of the potential capacity in its cube. Its lip assembly is not designed for heavy service life nor is the lip very efficient. The flared sides would be too flimsy for external chains. Building strength into this shape made it no better weightwise.

Page in addition to the bucket shown in the Page patent shown in paragraph 2, also built in about 1955, a bucket similar to Weirmer's with slopes close to the same angle as the Belendorf bucket. The bucket dug and dumped well, and it was archless, but it was to heavy to gain widespread popularity.

Internal chains as the Belendorf patent calls, is less stable and operates the bail chains within the basket of loaded earth. This arrangement of the bail chains, can blind loading and obstruct clean dumping of the rear corners. The stability loss with this configuration is undesirable, as is the high wear caused by the harsh environment of rocky or sandy earth on the useful life of the bail chains and hitches. I first built an upper brace type arch in 1976 in lieu of the full arch, and found it to be too rigid, and started abandoning it in 1978.

Briscoe U.S. Pat. No. 5,084,990, Feb. 4, 1992, shows buckets in a reverse-V configuration to eliminate slewing when encountering off center digging. This effort is applaudable, but it requires much alteration of a straightforward design, and is not worth this effort. As it is shown, buckets of this design wear much faster and require much more service to the leading outside teeth. The ratio of support to digging width is approximately 1.25:1. This is about the industry average.

Also, the tilt back and carry has been addressed and used, but hardly adequately to be considered economical. It has been associated with additional linkages and heavy rigging. Only with elevated skill and attention of the operator, can pendulous rhythm be maintained in the dump mode, and not allow the dump rotation of the bucket, until past vertical suspension. To quickly and smoothly pivot on its bail hitches, or additionally to extend another one half to one full bucket length, without stopping or slowing the outward momentum of the departing load of earth, is beyond the skill and the attention of the operator. It is forfeited by the heavy weight of the bucket of former buckets.

Fatigue of an operator, lack of elevated skill, poor setting of the dragline, combined with the heavy weight former buckets makes maximum reach stressful, and only a marginal bonus angle past the vertical suspension. Heavy drag forces followed by the heavy release forces establish rapid deterioration of the pendulous rhythm and swing, and cause high induced loads to both the hoist line system, and the bucket rigging. The angle of the hoist line of this pendulous inswing denotes the high, approximate 160%, induced loading of the hoist system. It is now pulling down, and working against the hoist, adding to the hoist line load. This unhandy maneuver, then, must be followed by heavy to moderate to light transition braking forces on the drag. All of this requires a high inswing angle, resulting in the extra heavy lifting forces by the hoist.

During attempted pendulous rhythm of dumping, this combination of high to very high intermittent induced drag and hoist forces are required to allow the floating equilibrium adjustment and to maintain the tilt angle of the bucket. Again, if this coordination exercise suffers too many of the mentioned maladies, then the pendulous rhythm and the direct trajectory is forfeited, and a resulting heavy swinging forces must be attempted to localize the predicted dump location. This results in random dumping. This melee of maximum reach with former art may be used of necessity, but it comes at a high price. High loads of up to 225% of the suspended load may be imposed during this initial close inswing, that commences the attempt of a pendulous rhythm outswinging, to dump the bucket at or near maximum reach. Minimum loads of 125% of the suspended load are usual with former buckets.

Special excavation as wet sticky earth or dredging or excavating boulders behind a poor blast, rubble or tree stumps could delay, or could be impossible to load without assistance using former buckets. Because the bucket needs more opening, it could also be difficult to discharge on dumping.

Historically as they incremental up sized former buckets, larger drag cables of higher strength cable were required and used. Upon dumping, the swinging back and lowering of the empty bucket into the pit with former bucket, the dragline might still be working to about 40% of its capacity with just the weight of the empty bucket.

If the dragline is already worked at its recommended limit, any oversizing of the bucket to increase the production with any conditions less than optimum can result in lost time and serious repair to the draglines, using former buckets. This up sizing, when first commenced to increase the capacity of the buckets resulted in heavier duty cycles to the dragline and the bucket along with its rigging. Approximately 14% more capacity brought on at least 25% more "wear and tear" and costs. After much trial and change and user demands, the buckets later, were up sized and made heavier.

With prior art, no more than approximately 90% of the earth is loaded directly into the bucket, and with great effort within the near vertical walls. The rest is recirculated and also part is left behind as a roll of earth. It is unfortunate that with prior art, this rework occurs during the heaviest part of the work cycle.

Heavier loads demanded of prior art buckets brings heavier sides and backs and bottoms, many with compound curves and shapes. Not only is it burdened with added weight, but added expense, and less tolerance. Chains wear against the intolerant sides. There was more mass to wear out and more to replace. Sides, backs, and bottoms had wear plates added because they did not fit the cleave planes left behind the lip. Prior buckets with a D or squarish O front view, and a long narrow D top view, and straight sides cannot provide the strength and the tolerance built into this new bucket. The inside of the buckets need special congruent wear plates too, because earth is being extruded into them with great force causing higher abrasion. There is little or no increase in cross section within the bucket to allow lateral swell of excavated material. It is squeezed and forced upward at a great loss of effective draft power. This is multiplied by the desire to quick load in 1.5 to 2 lengths of the bucket and to "go for the big loads" to get a lot done.

OBJECTS AND ADVANTAGES OF THE INVENTION

Accordingly, besides the objects and advantages of the low draft, high yield bucket system for draglines described in this patent application, several objects and advantages of the present invention are:

a. to provide a low draft bucket returning to former standard size and strength of cable and downsizing rigging while adding new excavating technology, and new multi use bucket components.

b. to provide a bucket with good strength, less weight, good logistics, and less cost, that includes anti slewing qualities.

c. to provide excess cube inside the bucket a means for fast loading with far less approximately 50% of the drag forces.

d. to provide fractured earth blooms right inside the bucket up to 150% of the payload of prior buckets, requiring as little as 90% of the same Horse Power.

e. to provide a bucket that recovers approximately 100% of the earth engaged in loading.

f. to provide approximately a 66% increase, in the inside width of the bucket, allowing abundant excess room for earth pressures to reduce and to fill with very light wear on the sides internally.

g. to provide excess room with this multifaced hemisphere or inverted pyramid shape means easy dumping out the front and the top.

h. to provide the least contact for the cube to eliminate the cause of delay or stickiness in releasing the earth when dumping.

i. to provide light weight stronger, lighter, longer rigging to take advantage of the better weight and geometry.

j. to provide the optimum rigging for the dump block, an important part in the tilt back system.

k. to provide an optimum loading distance of approximately 3 bucket lengths to greatly reduce spike loading modes.

l. to provide a precise tilt back control system as a means to reduce the drag release forces, while maintaining a precise tilt back until the bucket reaches its desired dumping radii.

m. to provide a precise tilt back system for more pay load on the bucket by stabilizing the load.

n. to provide a precise tilt back system to tilt off excess earth for a calibrated load, if necessary.

o. to provide a precise tilt back to allow direct trajectory, and require lighter forces to swing and drag.

p. to provide a precise tilt back system with a natural inswing and requiring lighter forces to swing and dump the bucket.

q. to provide a precise tilt back system that requires lighter hoist and drag forces while in flight.

r. to provide a precise tilt back system that reduces the lift forces to approximately 110% of gross weight, instead of approximately 125%.

s. to provide a precise tilt back system that allows a potential gross load of approximately 110% of existing rated suspension loads because of the improved calibrated radii and progressive dumping.

t. to provide a precise tilt back system that allows a nearly free pendulous swing of the bucket to a desired angle past the vertical suspension.

u. to provide a pendulous rhythm in operation by requiring light release loads on the drag cable while maintaining the dump line socket and stop 32 against the dump block stop 34.

v. to provide control that allows the nearly free pendulous swing of the bucket, to a desired angle past the vertical suspension.

w. Separation of the dump line socket and stop 32 the dump block stop 34 begins releasing the tilt back system.

x. to provide a balance and control that keeps the bucket operating at or near maximum range and capacity.

y. to provide a bucket structure with sufficient strength to perform without the need of the arch or upper brace or other components and weight of prior buckets.

z. to provide isolated effective wear areas and make them quickly and economically serviced.

Further advantages of my invention will become apparent from a consideration of the drawings and ensuing description.

DRAWING FIGURES

Figure 1:
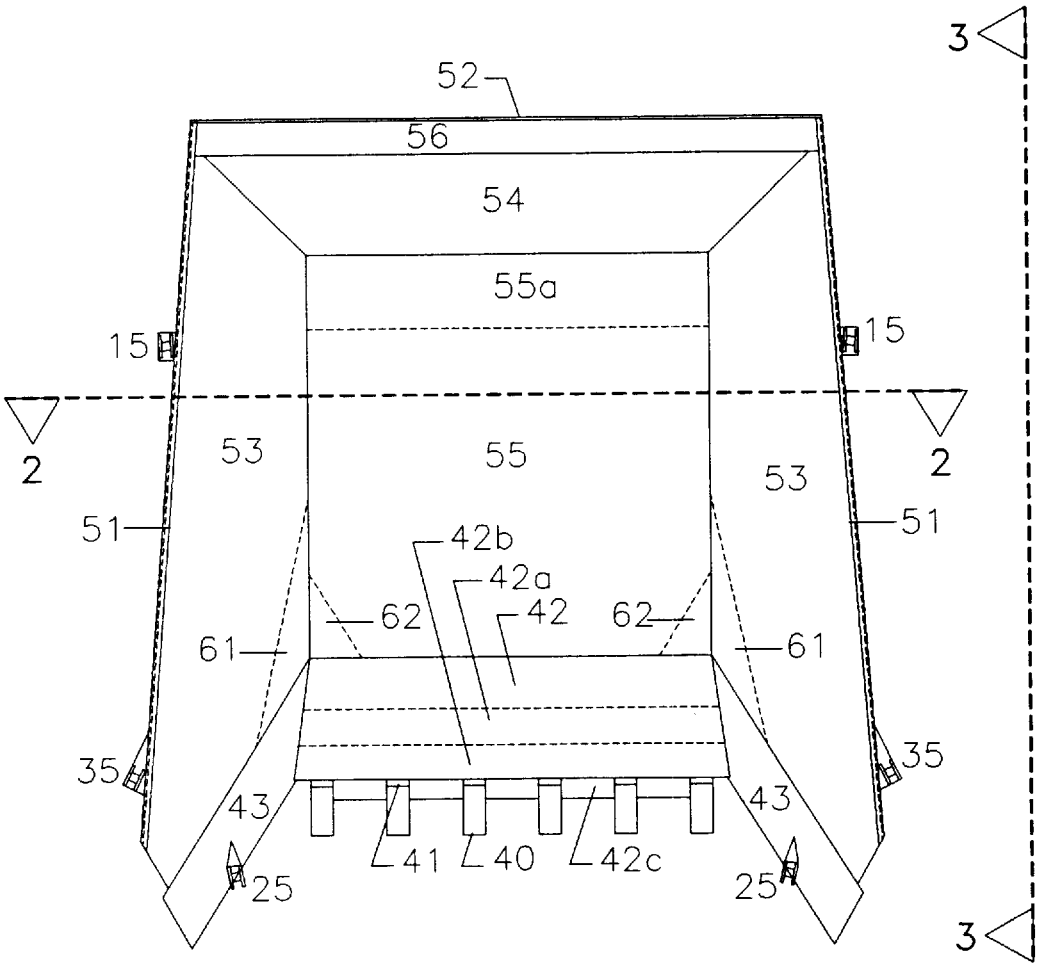
FIG. 1 Shows a plan view of a bucket in accordance with my invention.
Figure 2A:
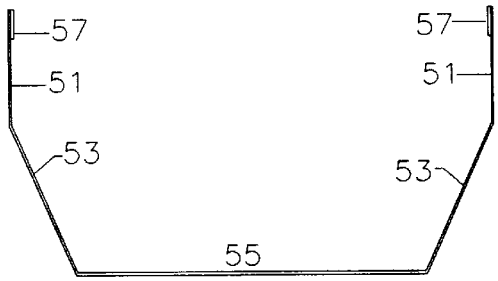
FIG. 2 shows a cross section view of a general heavy excavation bucket taken at the center of the view of FIG. 1.
Figure 2:
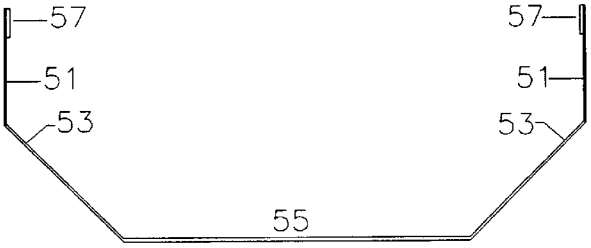

FIG. 2*a* shows a cross section view of a hard rock of a small target bucket taken at the center of the view of FIG. 1.

Figure 2B:
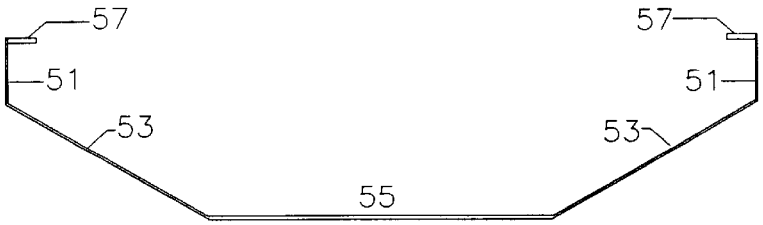

FIG. 2*b* shows a cross section view of a dredging, rehandle, or an environment bucket taken at the center of the view of FIG. 1.

Figure 3:
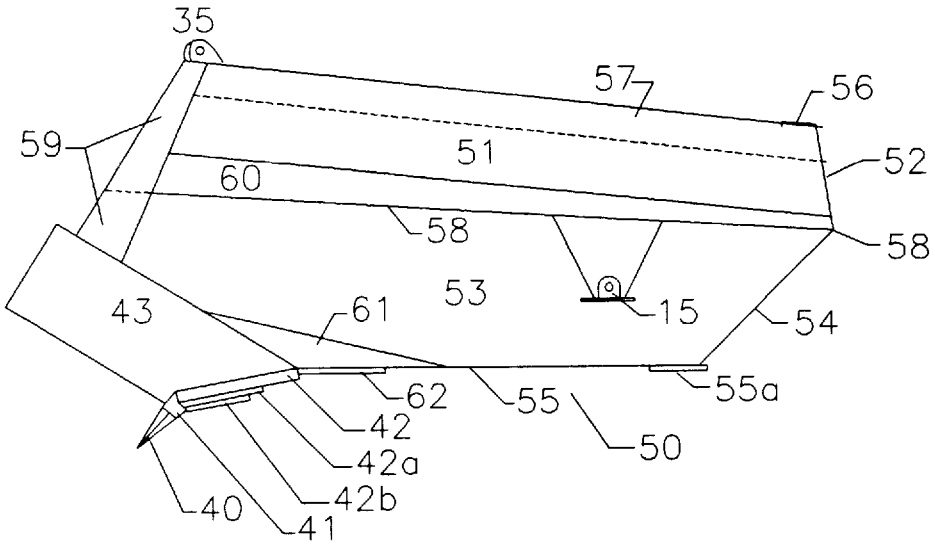

FIG. 3 shows a side view of the bucket of FIG. 1.

FIG. 4 shows the bucket starting a load.

FIG. 4*a* shows the tilt back system releases during loading.

FIG. 5 shows the loaded bucket in flight to the dump area.

FIG. 5*a* shows the tilt back system carrying the load at the preset angle of tilt.

Figure 6A:
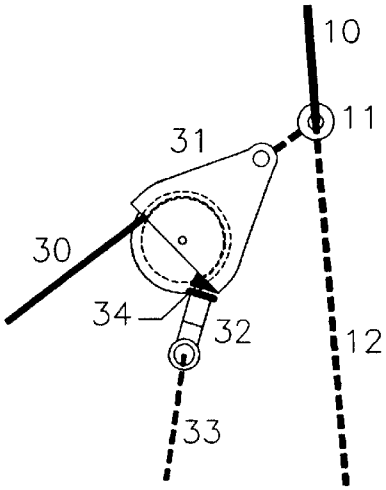
Figure 6:
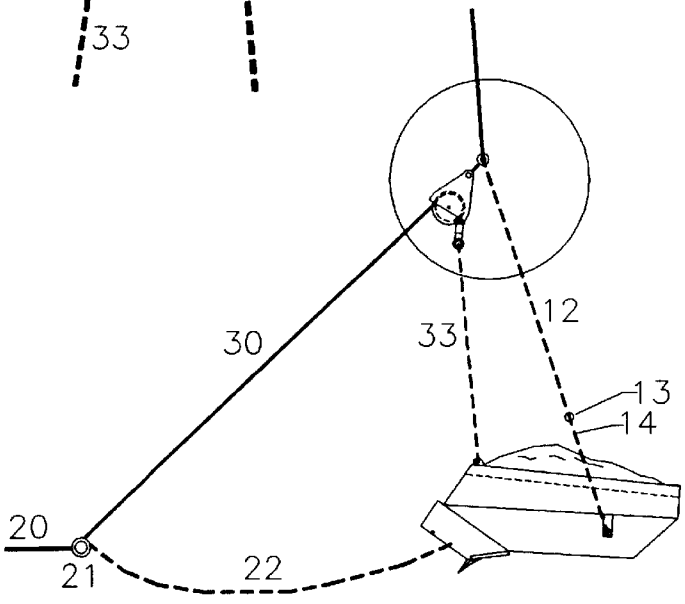

FIG. 6 shows the loaded bucket passing vertical suspension.

FIG. 6*a* shows the bucket is still in full tilt back.

Figure 7A:
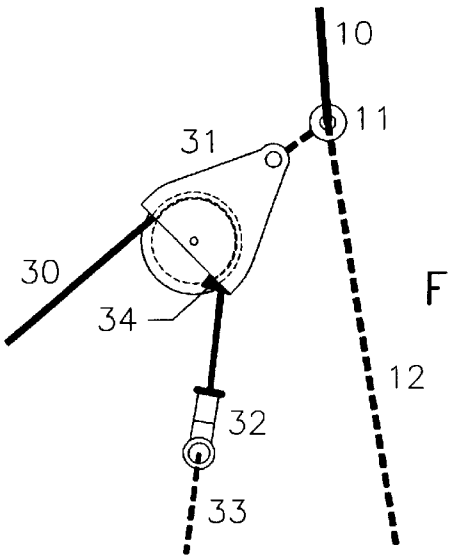
Figure 7:
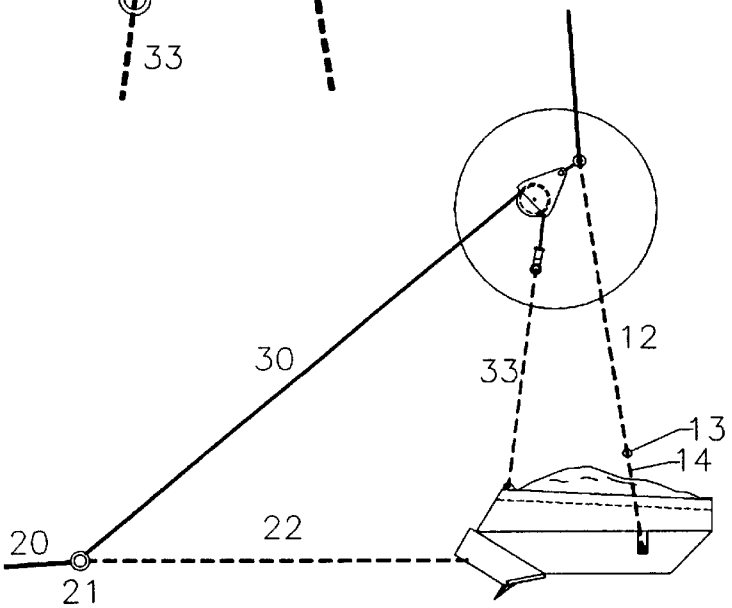

FIG. 7 shows the bucket at the end of the pendulous outswing.

FIG. 7*a* shows the tilt back system is releasing to dump.

Figure 8:
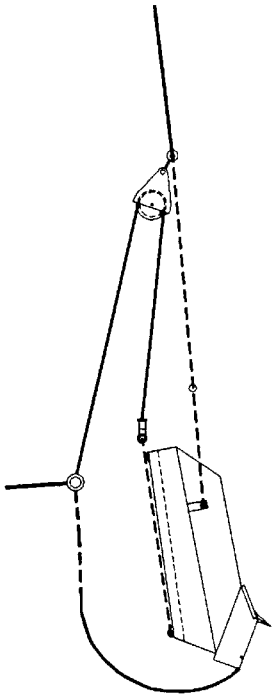

FIG. 8 shows the bucket vertically suspended in the dumping mode.

Figure 9A:
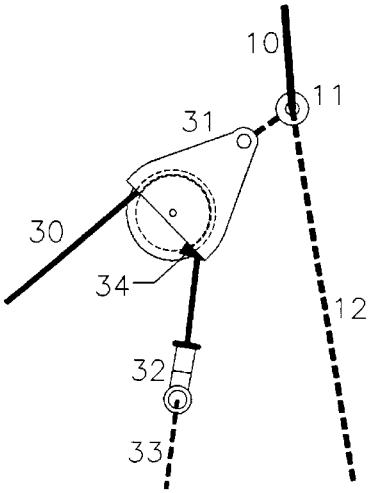
Figure 9:
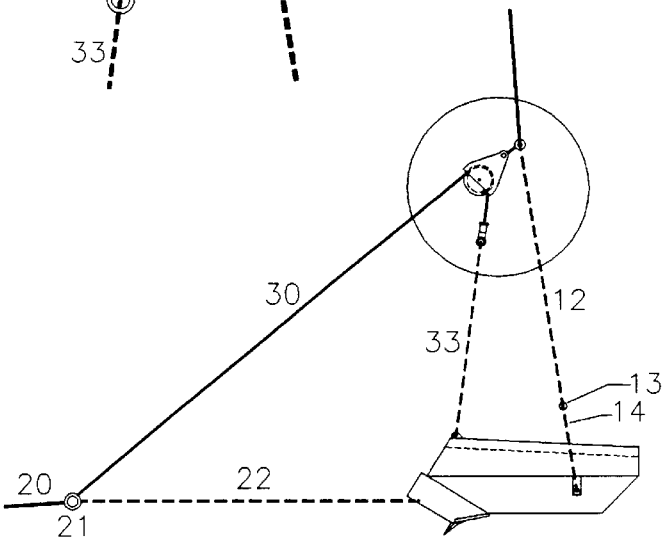

FIG. 9 shows the bucket horizontally suspended in flight returning to the pit, momentarily to be lowered and commence loading.

FIG. 9*a* shows the bucket tilt back system is released.

Figure 10:
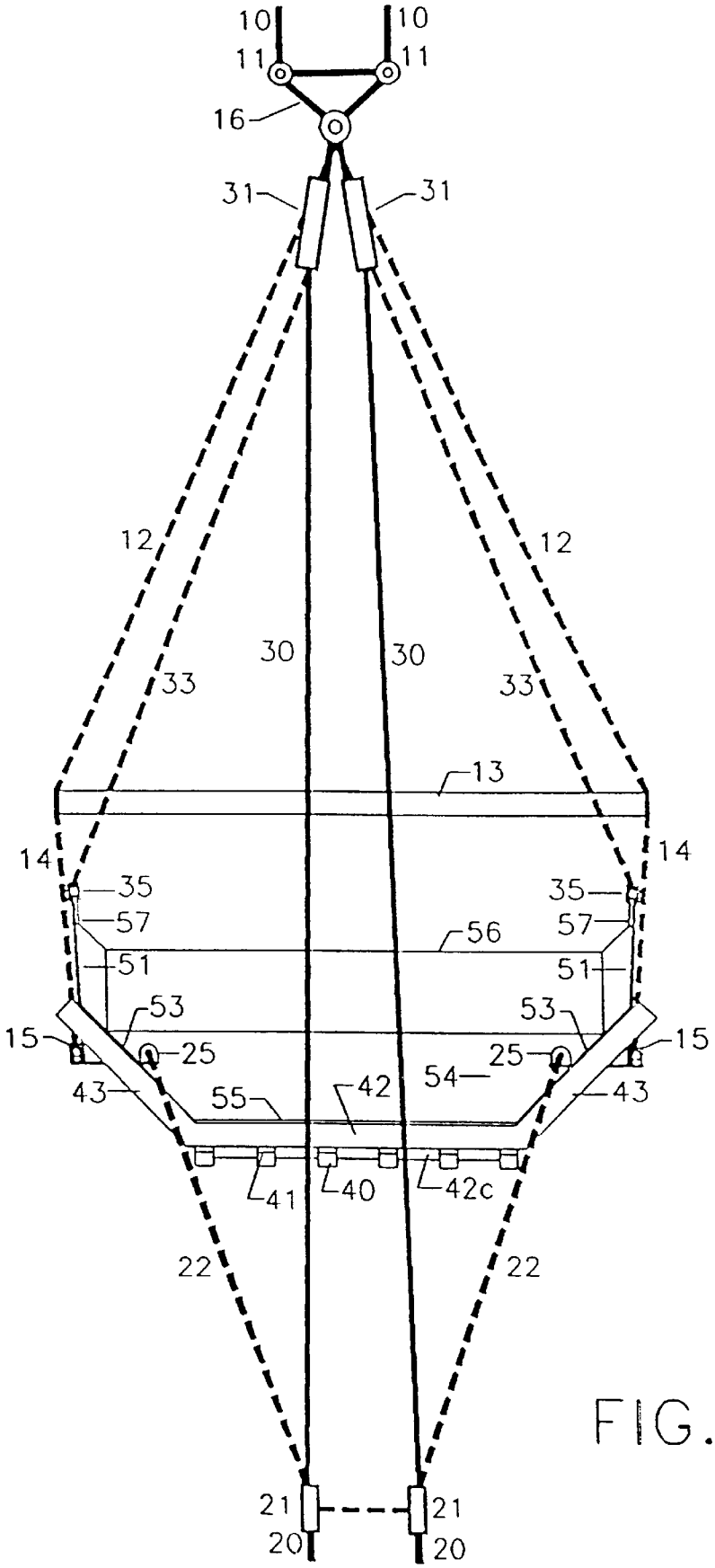

FIG. 10 shows the front view of a double rigged bucket in accordance with my invention.

Figure 11:
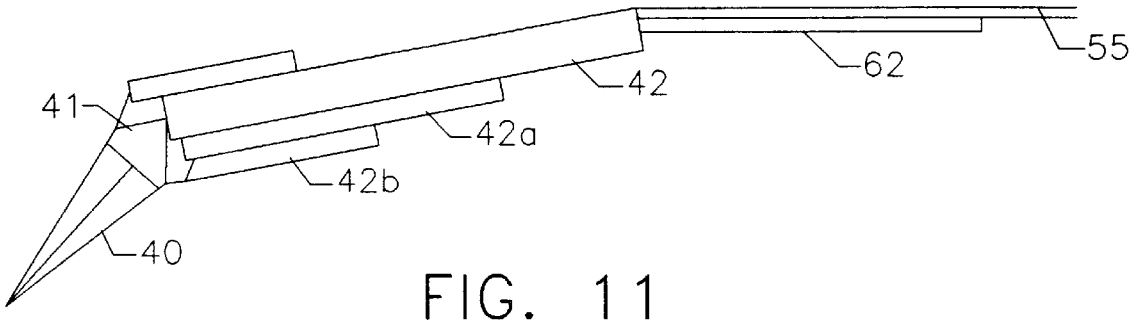

FIG. 11 shows a typical cross section of the lip with two laminae at a tooth as per FIGS. 1 and 3.

Figure 12:
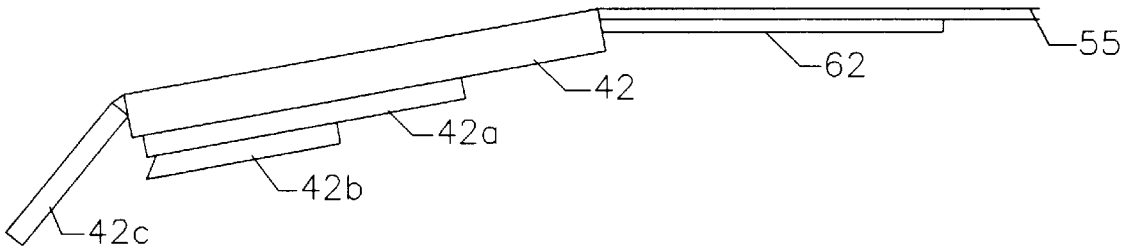

FIG. 12 shows a typical cross section of the lip with two laminae between the teeth as per FIGS. 1 and 3.

Reference Numerals In Drawings

| | | | |
|---|---|---|---|
| 10 | hoist line | 42 | lip |
| 11 | hoist socket and eye | 42a | lamina upper |
| 12 | spreader bar chains | 42b | lamina lower |
| 13 | spreader bar | 42c | cutting edge |
| 14 | bail chain | 43 | lip end cutter |
| 15 | bail hitch | 50 | bucket basket |
| 16 | hoist equalizer and eye | 51 | upper side |
| 20 | drag cable | 52 | upper back |
| 21 | drag socket and clevis | 53 | lower sides |
| 22 | drag chain | 54 | lower back |
| 25 | drag hitch | 55 | bottom |
| 30 | dump line | 55a | optional wear plate |
| 31 | dump block | 56 | rim at top back |
| 32 | dump line socket and stop | 57 | rim at top side |
| 33 | bridle chain | 58 | flange break |
| 34 | dump block stop | 59 | front rim |
| 35 | bridle hitch | 60 | mid rim |
| 40 | tooth | 61 | lower rim |
| 41 | teeth adapter | 62 | gusset |

DESCRIPTION—FIGS. 1 to 12

The bucket of FIGS. 1–10 resembles a slightly tilted hemisphere open on the front side. The front view FIG. 10 illustrates its shape which is like a multifaced reclining symmetrical C with a flat bottom, which center between the sides represents the axis of the bucket. Its sides are straight and multifaced, as is its back. The bottom 55 is flat and forms an inverted trapezoid, as it joins the similarly shaped leading edge ground engaging section. The bottom 55 and a lip 42 are attached and become the bucket bottom assembly FIG. 3. Teeth 40 attach to the front of a lip. The lower sides 53 and a lower back 54 slope outward as they rise to form a bottom 55 and a lower back 54 and lower sides 53 FIG. 10, form angles from approximately 20 degrees to approximately 60 degrees from vertical as they rise, depending upon the application.

The lip end cutters sweep forward and upward between 20 and 60 degrees from the lip and are flared outward between 8 and 20 degrees and are connected by the lip, which is flared downward between 8 and 20 degrees, with a lamina means of reinforcing the lip. The teeth and cutting edges are attached approximately 20 to 70 degrees downwardly.

The basket section of the bucket also includes bottom 55 with lip 42 and lip end cutters 43 as part of the spine. But additionally, lower sides 53 and lower back 54 are all three attached to the bottom 55 and completing the bottom of a multifaced tilted hemisphere.

The upper sides 51 and the upper back 52 join in the corners leaning slightly inward at the top FIG. 10, while they slope slightly outward from vertical at the front. Descending they join lower sides 53 and lower back 54. The sides and the back both slope significantly inward and join the bottom 55. The top of the basket profile, although nearly straight, generally tilts downward to the rear.

This new, unique shape adds considerable structural strength FIG. 1.

A flange break 58 where the slopes join at the lower sides 53 and the upper sides 51, and the lower back 54 and the upper back 52 forms an additional stiffened aligned flange break 58. A rim at top back 56 is attached to the upper back 52. The upper sides 51 join the rims at top sides 57 which join the front rims 59, and descend to front of the bucket.

The Front rims 59 descend to join the leading edge ground engaging section 40–43, and the upper extremities of lip end cutters 43. The lip end cutters 43 are joined by a lip 42 with teeth 40 and cutting edges 42*c* protruding forward and downwardly. A lamina upper 42*a* and a lamina lower 42*b*, as shown in FIG. 1 beneath the lip 42. A reclining C section shaped, leading edge ground engaging section has sufficient strength, rigidity, and tolerance that it does not need an arch or upper brace as required for prior buckets.

To this leading edge ground engaging section are attached the lower sides 53 with the lip end cutters 43 joining the lip 42, and joining the bottom 55. Attached are two mid rims 60 just above the flange break 58 and the lower rims 61 to the lower face of the lower sides 53 and the gussets 62 to the front lower outside of bottom 55 to complete this slightly tilted, multifaced, hemisphere bucket.

The bucket structure is comprised of four C sections. FIG. 1, a plan view, demonstrates a large flat structural C open to the front. This large structure C rises from a much smaller bottom and is formed by the back and both sides of the basket. A second C is a heavy back reclining c, its back lying lower front reaching forward and upwardly, commencing from a drag hitch 25, to one of the lip end cutters 43, to the lip 42, to the lip end cutter 43 opposite, and to a drag hitch 25 opposite. Thirdly there is a reclining c reaching vertical, from a bridle hitch 33, to a lip end cutter 43, to the lip 42, to the opposite lip end cutter 43, and to the opposite bridle hitch 33. Fourthly, there is a smaller reclining C, as a channel running lengthwise, approximately centered on the flange break 58. It begins at a lip end cutter 43, and proceeds along one upper side 51 and a lower side 53, then across the upper back 52 and lower back 54, it then proceeds forward along the other upper side 51 and lower side 53 to the opposite lip end cutter 43.

Attached to the lower sides 53 and slightly below and behind the center of gravity are the bail hitches 15 which attach to the bail chains 14 which rise to a spreader bar 13. Spreader bar chains 12 commence at a spreader bar 13 and apex at a dump block 31 as shown in FIG. 4*a* through FIG. 9*b*. A hoist equalizer and eye 16 and a plural of dump blocks 31 may be used with a dual rigged bucket as shown in FIG. 10, or a hoist socket and eye 11 for a single hoist line 10.

The lip end cutters 43 sweep forward and upward, and slope outward from the lip 42 to the drag hitches 23 which are mounted inside. A wide mouth bucket results with widely spaced drag hitches 25 and protection from swing bump. Drag chains 22 angle forward together to meet at the drag clevis 21 and dump line 30. There is the added width of the hoist lift points to the outside width of the teeth, ratio of approximately 1.66 to one, while former buckets average about 1 to 1. The hoist line lifting from the bail hitches 15 extended approximately 66% past the width of the lip 42 and the bottom 55 create an inward force on the sides of the bucket that is used to combat and compensate excessive internal earth pressures which are activated by the heavier earth loads. The lip end cutters 43 form planes on both sides and the lower sides of basket 53. They sweep rearward and downward for a good cutting and gathering angle. The bridle chains 33 hitch to bridle hitches 34 at the top and front of the upper sides 51 and the front of rim at top sides 57. For mass earth excavation, there normally is no arch nor tubular support, as in prior buckets. However, either single or double rigging can be used.

The dump line system of the bucket involves a cable run from the drag cable 20 connection to the drag socket and clevis 21 with drag chains 22 and dump line 30, through a reversing block commonly called a dump block 31, and then back to the upper forward bucket, to bridle hitches 35. On this bucket, they are located at the front of the upper sides 53 and the rim at top sides 57, and the top of front rims 59. It is an arrangement that is very old art.

A standard dump line 30 as FIG. 5*a* is adjusted so that the dump line socket and stop 32 is held against dump block stop 34. The spreader bar chains are lengthened or shortened so that the tilt back, is at the optimum carry angle. The tilt back is precisely controlled by the proper length of bridle chains 33 lifting the front, and spreader bar chains 12 and bail chains 14 lifting the rear of the bucket.

Bucket rigging has been shown with both single and double rigging to the hoist, drag, and the dump system. The smaller buckets use the single rigging, while the larger dragline and buckets use the double rigging.

All hitches are orientated toward the mean working plane. The working plane is radial to the pins.

OPERATION—FIGS. 1 to 12

A dragline, a swing machine works from a center of rotation. The working radius represents the distance the end of the boom supporting the hoist line reaches. The hoist line 10 hanging vertical is considered vertical suspension. A dragline 30 works dragging towards the machine. When loading the bucket (dragging the bucket), the shape of the structure, the strength, the weight and the tolerance are very important to the performance of this bucket.

When the bucket structure is pulled by the dragline, the teeth 40 fracture the earth by the high angle of 20 to 60 degrees from the horizontal relative to bottom 55 and provide the highest possible penetration pressures. As the forward motion progresses, the fractured and cleaved and resultant heaved earth is uplifted and contained within the outward sloped walls of lip end cutters 43, and the sloped lower sides 53 of the basket. This wall angle ranges between 20 degrees and 60 degrees from the vertical depending upon the earth properties being excavated and the bucket application.

The buckets have between 8 and 20 degrees of set or flare downward in lip 42, and lip end cutters 43, have between 8 and 20 degrees of set or flare outward as can be seen in the front view FIG. 10, and plan view FIG. 1. The lamina 42*a* and lamina 42*b*, and cutting edges 42*c*, make up the rest of the components for the ground engaging system. They are installed at these angles to provide good strength and no obstruction, to give long service life, and to retain a required set, necessary for good service and a minimum of repair.

When digging, nearly all of the forward energy is used to fracture, cleave, swell, and heave the earth. The bonus of using the swell and heave caused by the fracture and cleavage of the 40, uplift and expand the earth within the confinement of the swept and outsloped lip end cutters 43 and lower sides 53. This configuration provides a highly efficient means for rapid fracture, cleavage, swell, heave, and uplift of the earth that results in loading more cubic yards of earth per time with less power. As little as 90% of the horse power yields up to 50% more capacity under like conditions, with former buckets. The lip 42 and lip end cutters 43 excavate and up lift a channel of lower density earth that rapidly mounds itself high into the upper forward center of the bucket and continues as initiated by the points of the teeth 40, FIG. 1, FIG. 5A, FIG. 10. This uplifting is accomplished with less resistance and more excavation per time. Under most conditions, this quickly blossoming hill of earth in the front central bucket now flows down its slope to quickly fill with a relatively uniform center heap, against the insides and the back of the bucket.

The outside of the basket follows the cut of the inverted trapezoidal lip 42 and lip end cutters 43 which make an excavation track in the earth to, or slightly past the optimum fracture plane, initiated by the teeth 40. This fractured plane scraping, loads nearly all of the fractured and cleaved material, and reduces the abrasion on the bottom and the lower sides 53 of the bucket, and further reduces drag resistance.

Most of the remaining abrasion is concentrated against the back of the lower sides 53 and the rearward lower area of the bottom 55. These large, flat rectangular shaped areas provide a means to locate much flat steel and achieve a good support and a well defined abrasion resistant area, with easy accessible service and cost effective maintenance. FIG. 3 shows a wear plate 55*a* is added for extreme abrasion, to the bottom 55. It is an extremely simple, cost effective component.

Upon lifting, preparation for flight, a tilt back system precisely tips the bucket to a preset tilt back angle relative to the stops on the dump line. Tilted, it usually shakes excessive earth over the back and sides and leaves the bucket with a relatively predictable weight to match the operating weight of the dragline. When the drag cable 20 is held tight, the hoist line 10 lifts, the dump block and the bail hitches 15, connected to the rear of the bucket. Since the dump line is tight, the front of the bucket is lifted by the forces of the dump line 30 and bridle chains 33 at bridle hitches 34. The bucket is lifted in a precise tilt back.

The dump line 30 length is adjusted for the best tension against the dump block stop 35, for precise tilt back positioning of the loaded bucket, for carrying in flight to the dump location. Optimum tilt back provides smooth dumping of maximum payloads at maximum dumping radii.

The flight angle is a precise tilt back angle, a controlled position. The open front of the bucket is adjusted so that the front, the lip 42 and lip end cutters 43, the ground engaging section, is carried higher than the rear or the basket. The bottom 55 plus the upper sides 51 and lower sided 53 and the lower back 54 and upper back 52 make up the basket, the rearward section of the bucket.

The tilt back limits are arranged and constructed so that the dump block stop 34 working against dump line socket and stop 32 and the controlled length of the dump line 30 and/or bridle chains 33. Shortening or lengthening either tilts the bucket back or allows the bucket to tilt forward when dump line 30 positions the dumpline socket and stop 32 against the dump block stop 34 for carry FIG. 5*b*. As the bucket dumps FIG. 8 or is lowered to the pit FIG. 9*a*, the dump line socket and stop 32, moves away from the dump block stop 34 as shown in FIG. 4 or FIG. 9*a*. The dump block stop 34 and the dump line socket and stop 32 have been added for this invention and when connected, hold the dump line in its tilt back position and precisely tilt the bucket. When the dump line socket and stop 32 comes up and is held at dump block stop 35, it can be adjusted and set at optimum tilt and maintain good stability and prevent excessive tilt back, precisely for different applications.

This carry angle eases the operating control required for stable carry and a fast dump mode. Precise control means that the tilt back system can be used for a pendulous rhythm instead of the almost infinite control required of the operator, for float equilibrium, the tilt back adjustment of former buckets.

Precise tilt back control using the tilt back system requires much less sensitive control and much less energy to make a near pendulous outswing. The precise tilt back system locks the bucket in the precise tilt back angle relative to the dumpline stops and the drag release forces control both the tilt back and the resistance for the outswing. Maintaining the desired tilt back, by float equilibrium, requires balancing the amounts of release forces to outswing the bucket at the proper speed, while retaining forces must be adequate to prevent commencing the dump mode. If not, instability sets in, and the forces required to prevent premature dumping quickly increase, and devour extra momentum. The momentum is necessary to keep the bucket moving outward even though additional braking or drag resistance must be applied to uplift the front of the bucket to retard or stop the dump mode.

Without extra momentum, premature dumping will commence, and outswing will likely be halted. In order to have ample momentum for this maneuver, if is common that over amounts of inswing are performed in order to assure enough momentum for outswing to accomplish dumping at the correct distance. This momentum is necessary to prevent premature dumping and to handle instabilities of former buckets.

Maintaining a float equilibrium can be slight work, or overwhelming, depending on the operator skill and how far out you are dumping. Required amounts of momentum can vary considerably for several reasons. A front loaded bucket, will require more dump line forces for float equilibrium tilt back, therefore it will require more momentum reserve. To have a little extra float equilibrium tilt back control, for a spot dump, will require extra momentum. A direct trajectory swing, saves swing acceleration forces, but may require additional momentum, when dumping near vertical suspension. The farther out the vertical swing, more momentum reserve is required, with former buckets.

A precise angle tilt back system, does not require this extra momentum, but instead requires a far less amount, of restraining drag forces. It also reduces shock loads, and heavy hoist and drag line loads imposed on the bucket, rigging, and the dragline. This new art saves considerable energy.

Former heavier buckets with their higher center of gravity cannot use this precise angle tilt back system as it is utilized here, because the low hitches, used with the new art would present too much tilt forward at dumping. The dumpline interferes with the back end of the bucket and the empty bucket hang angle or dump angle, prevent dumping in the clear. It dumps too much earth against the arch or upper support, and cause jerkiness to the rest of the bucket and the hoist line 10. The empty bucket stands on the teeth and does not set down properly to dig.

The more distant dumping, with former buckets, is mainly controlled by outswing momentum and using a shorter dump line. Page's Miracle Hitch works, but it is more complex and not as precise.

The bucket with this tilt back system is less effected by an inadvertent fore or aft loading, because this tilt back control adds much stability to the bucket. To carry heaping or precarious loads as unintentional fore or aft loads, or in maintaining unusual control, the bucket dumps more smoothly and at greater distances. It does this while using pendulous rhythm and direct trajectory flight, both very advantageous.

Dumping more surely and smoothly at greater distances increases the range of the bucket without increasing its moment arm requirements, yet it maintains the buckets service duty rating. Narrower heavier buckets that the loads may delay in dumping, can expose the dragline to more "wear and tear" than this new bucket, especially when working at or near maximum reach.

Comparative Industry Weight of Former Dragline Buckets to New Dragline Buckets

| | |
|---|---|
| Heavy Service Duty (Rock) | |
| Industry Weight | 1,700 lb/cy |
| New Buckets | 950 lb/cy |
| Medium Service Duty (Clay) | |
| Industry Weight | 1,650 lb/cy |
| New Buckets | 700 lb/cy |
| Light Service Duty (Sand) | |
| Industry Weight | 1,400 lb/cy |
| New Buckets | 500 lb/cy |

This table shows the potential performance of applied New Buckets.

The hitches and the basket of the bucket are so much more cavernous, up to 50% wider than former buckets for the same dragline, that unusually large objects as boulders resulting from a poor shot, tree stumps, concrete rubble, etc., are almost unnoticeably ingested and discharged. Former buckets might find these same objects too large, and beyond their capability to be handled.

A wide mouth bucket results with widely spaced drag hitches 25 and protection from swing bump. There is the added width of the hoist lift points to the outside width of the teeth ratio of approximately 1.66 to one, while former buckets average about 1 to 1. The teeth are arranged to excavate a clear earthen configuration of a large regular shape for the basket, and a tooth width, to hoist line hitch, width ratio, of up to 166% of former buckets, is a means to provide a positive, proportionate increase in penetration pressures on the teeth opposite the support of the hoist lines, for good digging or economical anti slewing qualities, if off center digging conditions are encountered.

The need, for many special area wear plates of former buckets, are replaced by a single large simple optional wear plate 55*a*.

Materials used in this new bucket are generally 100 ksi steels, and up to AR 450 bernal hardness number or BHN. Using these steels requires that the manufactures recommendations be followed with preheat and good fabrication procedures as suggested by the AWA, American Welding Association.

Welding wire or electrode of 110 ksi tensile strength is recommended. Each of the different welding methods require their different preparations for welding and should give satisfactory results. Post stress relieving by peening or other means is important and will help high stress concentration areas.

The chains and fittings are 100 ksi steel welded chain with comparable fittings and connectors and are sufficient chains for the loads required.

Lip 42 and lip ends cutter 43 act as the forward ground engaging section and open the end of this slightly tilted hemisphere.

Because the rectangular shapes and the toughness of this material used in the construction, angular cut and fabricated shapes are used in the thickness of steel over 6.35 mm. These steels are tough to be cold formed. Hot forming is not done because of its cost, availability, and uncertainty of upsetting the metal tempering. These 100 ksi steels of up to AR 450 or similar quality are the choice to achieve the heavy service duty potential of this low draft high yield dragline bucket system for production rates up to 150% of former buckets.

The laminae 42*a* and 42*b* of the lip 42 are an important part as they could at much less expense and effort be replaced with a single plate of even a cast plate section. This substitution, however, could forfeit the advantage of insulation of heat stresses and the additional tolerance that is afforded with the laminae construction of lip 42, particularly the advantage of renewing by replacing the laminae.

Also the rectangular shapes as lip 42 and lip end cutters 43 have additional advantages. They engage the ground at the configuration of the leading edges of the teeth 40. This configuration is followed by lip 42 and lip end cutters 43 and exactly cuts the earth to make a snug trail for the bucket basket 50. It must be noted that the leading edge ground engaging section of the low draft high yield bucket system, incorporates teeth which yield the highest possible pounds per square inch, psi penetrating pressures. These teeth 40 are installed in the particular configuration to give high psi penetration, and to maintain and wear with approximately the same set (sharpness) throughout their useful life. The optimum angle is usually approximately 50 degrees from parallel to bottom 55. This angle may vary from 20 to 60 degrees. Excessive wear of the top side of the teeth usually indicates a flatter engagement is more optimum, while excessive wear on the bottom side of the teeth generally indicates s steeper angle of engagement up to 60 degrees from parallel to be more optimum. However, impacted teeth, by dropping the bucket, must be turned over regularly and are difficult to determine the optimum angle.

The tooth attachment angle becomes critical in order to accomplish four objectives simultaneously. It must first penetrate. Secondly it must displace the earth; it must cleave and heave. Thirdly it must act as a lifting foil, as a leading edge air foil, only for earth, to make a separation line and commence uplifting the earth which will be wiped clean, or definite, later, by the cutting edge 42*c*, by lip 42, and by lip end cutters 43. Fourthly, if there is high wear, the angle of this tooth mounting, the compromised angle, must include, an angle of engagement that yields the best wear pattern. The subject of teeth engagement angle will sometimes have to compromise with carrying extra earth. Frequently teeth 40 will support as much as 5% of the total pay load. They will actually support earth ahead of lip 42. The first consideration is penetration, but if penetration is not a problem, then wider teeth might accomplish the additional carrying capacity without acquiring a larger bucket. In summary the optimum angle of teeth 40 varies widely depending on its application. Approximately 50 degrees may be the best angle for the teeth in heavy earth and rocky material for the bucket that we are discussing. In dredging heavy cat tails, willow growth, or other marine growth, the teeth might need to be long and have a flat tooth setting, approaching 20 degrees. The primary function of these dredging teeth might be, to act as a fork, to carry out the important function, of removing marine vegetation, where teeth might normally not even be used for removing soft earth.

There is a broad range of teeth used, from a pointed tooth as an example, a Tiger Tooth, or a regular tooth 40 as shown in FIG. 1, manufactured by the G. H. Hensley Co. of Dallas, Tex. A cutting edge lip 42*c* shown in FIG. 11 is made from a bolt on, or weld on, A R steel plate.

Welding must be done following the recommendations of the AWA a familiar entity to welding shops. Additionally, any welding should have some method of stress relieving as peening, as with a pneumatic tool or some other method to reduce weld induced stresses.

When the bucket is loaded with earth, lip 42 and lip end cutters 43 are bridged with the highest density of earth and this most dense earth forms a forward containment. When tilted back, the bucket holds the earth for its flight to the dump area. Lip 42 and lip end cutters 43 also act as an ejection chute when dumping, FIG. 6. Free flowing earth as boulders, gravel, soil or dredge tailings, can be dumped slowly. However, a high angle of dump rotation, will allow earth to be released as the high forward sides breathe outward and allow the earth to fall directly from the bucket scarcely touching the bucket as it departs.

If a bucket is built to dig remotely, by merely being pulled with the drag cable, then properly located hitches and stabilizing gear are needed to make it fill quickly. Lip 42, the primary working tool and its stabilizer the bottom 55, plus lower sides 53 and lower back 54 are the spine of the bucket. The upper sides are a low pressure containment and preload the total basket structure which acts with the lip 42 and lip end cutters 43 to replace the arch or the upper support found in the heavier former buckets.

Lip and cutters 43 are usually the same gage as lip 42 and are welded together with multiple stringer beads of welding passes and they are stress relieved between passes. Upon completion of lip 42 and lip end cutters 43, this massive, durable, tolerant, leading edge ground engagement section is attached to the bottom of the basket 55. These components come together to make up the spine of the bucket. This can be seen in FIG. 1.

The structure of lip 42 of the leading edge ground engaging section of a heavy duty service bucket application represents the low draft high yield bucket's most complicated configuration.

Because high tempered, high strength steel from 100 ksi tensile strength, and highly abrasive resistant steel usually 350 to 450 BHN (bernel hardness number) are used; the preparation, weldments, and configuration of the structure are unique and unobvious to achieve bucket weights of 900 lb/CY or less that will handle up to 150% of former buckets, with the same dragline capabilities.

This unique lip construction, withstands heavy digging loads that cause high bending forces. The thin lip has a high span to thickness ratio of up to 25 to 1. This leading edge ground engaging section experiences extreme exposure and is constructed and arranged to have the strength and abrasive resistance. By arranging a rectangular cross sectioned piece of steel approximately 6 to 1, width to thickness and approximately 40 to 1, length to thickness, a lip. This lip being constructed in a position of 8 to 20 degrees below horizontal by its width dimension. and a like 6 to 1, width to thickness of steel plate attached to each end of this lip approximately 25 to 1, length to thickness, or lip end cutters. These steel plates attached on either end of the lip being constructed so that they slope outward at an angle of 20 to 60 degrees past vertical, with a set or flared outward at 8 to 20 degrees. These steel plates, or lip end cutters are also tilted forward from 20 to 60 degrees above the horizon. The lip is massed and pointed, or forward faced with a cutting implement, or teeth, or cutting edges that extend forward and downward between 20 and 70 degrees. This mass, or hardware, or teeth, or cutting edge are attached by construction methods that avoid transverse stress. The lip is reinforced with steel plates, or laminae that are longer and narrower ratios than the lip, and are added to and attached to the bottom of the lip, by construction methods with transverse free stress by eliminating and isolating transverse heat stress and transverse metal irregularities. The lip is attached to a rearward horizontal diaphragm, or plate, or a bottom. The additional arrangement of tilting, or flaring the lip and the lip end cutters adds depth to both the lip and lip end cutters.

By adding and attaching the laminae to the lip this arrangement, the zero axis is lowered below the lip and both the lip and the laminae are renewable, or repairable. The lip, by this arrangement is primarily a compression member and isolated by the laminae from the tension loads, the most severe or destructive application. Because the lip is primarily a compression member, steel plate, or teeth, or cutting edges can be welded, an ideal application for the abrasive service, where much welding can be required, with good expected service life.

The additional arrangement of using the laminae as a tension member on the lower side of the lip isolates it from abrasion service and heat stress from welding on the lip. It removes the laminae from construction methods with transverse stress. By eliminating and isolating transverse heat stress and transverse metal irregularities. This heaviest used structural part of the bucket can be quickly, handily, and economically renewed.

This structure and arrangement provides a means for constructing a unique leading edge ground engaging section with sufficient strength, rigidity, and tolerance to build a bucket with weight is little as 900 lb/cy for heavy service duty, with weight as low as 700 lb/cy for medium service duty, and weight as low as 500 lb/cy for light service duty bucket rigged weight. Nearly all weldment to lip 42 is on the upper front, the compression side, except teeth adapters 41 and laminae attachments 42*a* and 42*b*. Only longitudinal welds are permitted except at lip end cutters 43 attachments, at the ends of lip 42. Both teeth adaptor 41 and cutting edges 42*c*, FIG. 10, between the teeth, are welded simultaneously continuous and are peen stress relieved between welding passes. It is important that weldments be made to the recommendations of good practice and of the American Welding Association (AWA). A particular manufacture guide, example would be "HOW TO WELD T1 Construction Alloy Steels" March 1981 Edition, by United States Steel, 600 Grant St., Pittsburgh, Pa. 15230.

Weldments to the tension side, the bottom side of lip 42, are made longitudinal to lip 42. Small stringer welding passes between teeth adapters 41 and lip 42 and to first lamina 42*a* are made contiguously. Then welding passes between teeth adapters 41, lip 42, and second lamina 42*b*, continue contiguously as the welding passes progress outward. Many small stringer welding passes, however many that it might take, require peening or a method of stress relieving between passes.

Weldments to the compression side, the upper side, are also made longitudinal to lip 42, in stringer welding passes, and they include the upper, multiple, and heaviest attachment, the teeth adapters 41, see FIG. 11, and the cutting edges 42*c* between teeth 40, FIG. 12. As the welding passes continue outward from the center, now the lower portion of the leading edge of the lip 42, it is intended that these components be welded contiguously to avoid areas of welding stress concentrations. Peening or a method of stress relieving between passes must be incorporated. The bottom of the cutting edge requires stringer welding passes and stress relieving.

First lamina 42*a* and second lamina 42*b* add thickness to lip 42,as can be seen in these figures, FIGS. 1-3-11-12, but very importantly, these laminae are separate pieces attached securely to the lip and transfer the neutral axis from the center of lip 42, to relatively, the bottom of lip 42, where the lamina 42*a* and then 42*b* adjoin. This puts the greater portion of lip 42, almost separately from the laminae in compression. Lip 42 increases in compressive mass by the addition of teeth adapters 41, FIG. 1 & 3, and cutting edges 42*c*, and can be seen in FIG. 13, between the teeth; and almost entirely leaves laminae 42*a* and lamina 42*b*, to essentially, handle the tension forces of lip 42 longitudinally. That is resisting forces, pulling downwardly on the lip, and to assist with torsional loads.

This new art, longitudinally wise, ideally places lip 42 in compression, and laminae 42*a* and lamina 42*b* in tension. This is the most optimum application, for the abrasive resistant, and the massive compression applied to the lip 42; and for the expendable and replaceable heavy duty tension service of laminae 42*a* and 42*b*.

The lip 42 and said laminae 42*a* and 42*b* assembly is fabricated with no transverse welds except the ends. By this means, these laminae 42*a* and 42*b* with no transverse welds, attached to the lip 42 and greatly increase the strength and isolate stress concentrations to assure good strength needed for torsional and lateral rigidity of this leading edge ground engaging section.

Uncommon to former buckets, longitudinal welds only, of lip 42, even for teeth adapters 41, and the cutting edges 42*c*, make possible the high percentage of strength increase by using these laminae 42*a* and 42*b*. They make up an undisturbed heat stressed or thermally undisturbed section of high tempered steel from 100 ksi yield for the bottom or the tension side.

Forward lateral impacts compress the front of the lip, and mostly impose the tension on the rear edged side of lip 42, bolstered by the connecting edge of the bottom of basket 55.

This combination of components of the leading edge ground engagement section 40–43, FIG. 1, fabricated as set out above, amounts to a composite strength considerably higher than former buckets, for the weight. This higher strength occurs, even though the structural length is approximately 50% more from drag hitch 25 to the opposite drag hitch 25, than former buckets.

This leading edge ground engagement section FIG. 1 and FIG. 3, also has considerably more tolerance and serviceability than former buckets. Closely observed, the bucket in hard digging, can be seen to breathe. On all buckets, lips usually fail at a tension location first. These lip laminae 42*a* and 42*b* almost make up the entire tension side of lip 42.

Should the need occur, these laminae can easily be removed and replaced, by following the original fabricating procedures with nearly new life expectancy. Lip 42, because it is now primarily a compression member, can be rewelded with good life expectancy.

The bucket structure is comprised of four C sections. FIG. 1, a plan view, demonstrates a large flat structural C open to the front. This large structure C rises from a much smaller bottom and is formed by the back and both sides of the basket. A second C is a heavy back reclining c, its back lying lower front reaching forward and upwardly, commencing from a drag hitch, to one of the lip end cutters, to the lip, to the lip end cutter opposite, and to a drag hitch opposite.

Thirdly there is a reclining c reaching vertical, from a bridle hitch, to a lip end cutter, to the lip, to the opposite lip end cutter, and to the opposite bridle hitch. Fourthly, there is a smaller reclining C, as a channel running lengthwise, approximately centered on the flange break 58. It begins at a lip end cutter 43, and proceeds along one upper 51 and lower 53 side of basket, then across the upper 52 and lower 54 back of basket, it then proceeds forward along the other upper 51 and lower 53 side of basket to the opposite lip end cutter 43. Prior buckets with a D or squarish O front view, and a long narrow D top view, and straight sides cannot provide the strength and the tolerance built into this new bucket.

From the lower part of the hemisphere, the inverted trapezoid, to the top of the bucket, only earth storage seems relevant. However, the continuation from this flange break 58 to upper sides of basket 51 is an important section. These sides act as a web for the C section developed from the shape of these upper sides of basket 51 and upper back of basket 52, a large C open in front, FIG. 1, plan view. Its ends of the C being lip end cutters 43. These feather weight sides, not only, encompass a vast cube of earth, but also the earth load stabilizes them. The more load, the more pressure on their sides, the more stable they become. Using their faceted, convex shape, they form another smaller C section formed vertically using rim at top of back 56 and rims at top of sides 57, as an upper flange, and bottom of basket 55 for the lower flange, as seen in FIG. 3 side view. The hoist line lifting from the bail hitches 15 extended approximately 66% past the width of the lip 42 and the bottom of basket 55 create an inward force which is used to combat and compensate excessive internal earth pressures which are activated by the heavier line loads. These compensating forces allow the use of a lighter structure and greatly increase the strength to weight ratio and the tolerance of this new art bucket.

These C shaped sides give a wide moment, and substantial support to the leading edge ground engagement section, FIGS. 1-3-13. The sides help to stabilize the fore and aft and torsional loads to lip end cutters 43, and the resulting twisting loads to lip 42 and lip laminae 42*a* and 42*b*.

The basket section 50–58, of FIG. 1, is a cavernous cube, directly behind and adjoining the leading edge ground engaging section, the sloping walls mean moderate basket wall pressures in lieu of high pressures of former buckets. The rim at top sides 57, upper sides 51, and lower sides 53 are attached at the rear by the rim at top back 56, upper back 52, and lower back 54. They are all connected to the bottom 55 and are contained in front at the top by the front rims 59 and lip end cutters 43.

As the bucket fills, there is increasing pressure exerted against the inside front. Drag chains 22 and bridle chains 33 apply progressive inward compensating forces as they drag and lift the bucket. As the drag pulls with more force on the front of the bucket, and the earth begins to exert pressure against the insides, the drag chains pull harder and add compensating inward forces,and combat excessive earth pressures. When the bucket is filled, the pressure of the loaded earth causes a swelling out on the front of the bucket which remains, as drag cable 10 goes into hold, applying only minimum inward forces on the front of the bucket.

However, upon lifting the bucket, bridle chains 35 lift centrally and pull inward on the upper front of the bucket. These compensating forces combat excessive earth forces that cause the loaded bucket to swell. The heavier the load the more the swell. The more lifting required of bridle chains 33, the greater the inward forces applied to bridle hitches 35, at the upper front of the bucket. The bucket actually has a slight squeeze giving it extra strength, and upon dumping, it relaxes and the earth frequently falls clear of the bucket hardly rubbing the inside.

Compensating forces for bucket swell are not necessary for the empty bucket. It is, however, a great advantage to have the simplicity, the bucket control, the light weight, the strength to weight ratio, and the tolerance afforded by this rigging arrangement.

The shape, the generous cube, the tilt back, the rigging advantage, the simplicity, the light weight, and the structural design have combined to make this new art the Low Draft, High Yield Bucket System For Draglines produce up to 150% for as little as 90% of the cost.

SUMMARY, RAMIFICATIONS AND SCOPE

Accordingly, the reader will see the low draft, high yield bucket system for draglines makes it possible to increase the payload, while protecting and saving the dragline and the bucket. Further reach in both digging and dumping are possible due to the light weight, rigging geometry and use of pendulous rhythm and direct trajectory. This tilt back system, a part of the entire bucket system provides increased performance of the dragline and dragline operator, while being economical, durable, and reliable.

Other advantages provided by this bucket are as follows:

It provides a light weight bucket with a lot more payload, i.e. it develops up to 150% payload in the same time with less effort.

It provides a leading edge ground engaging section, that nearly 100% of its excavation goes directly into the bucket.

It provides teeth that rip and fracture and cleave day after day and also start the flow of the earth that can be up to 150% of what has been done before.

It provides this composite of lip, lip end cutters, and laminae to form a tool to dig and to gather.

It provides long days of abrasive encounters, these components which are completely disproportionately lighter and stronger and are made to be repaired quickly to near new standards.

It provides components that combat abrasive excavation, while less economically repairable former buckets, might have to be salvaged.

It provides a bucket bottom, bottom sides, and lower side of the back, that stabilizes the leading edge ground engaging section and is forms a bucket spine.

It provides a spine, that helps maintain digging alignment and combating slewing, that supports the magnum payload in the basket,that provides attachment for drag hitches 25, and bail hitches 15, that do most of the lifting.

It provides teeth 40 that take the abrasive wear at the front of the bucket, and the bottom of basket 55, the most rearward lower side a wear plate 55*a*.

It provides a spine for this bucket that takes the good work with the tough, from gathering the sticky earth, to sorting and gobbling bouncing boulders, that goes with ingesting up to a day's worth of excavation, in just ⅔ of a day.

It provides a cavernous basket that handles the ingestion of rock, sand, boulders, mud, or just plain clean earth, and it discharges these magnum loads with practically instant response out the front and the top.

It provides a smoothness at dumping that are definite advantages, and effect operating efficiency.

It provide a long rigging between the dump block and the bail hitches that requires less effort to change the lifting geometry to move the dump block forward and get a straighter uplift of the bridle hitches.

It provides the reverse when dumping; the relaxed bridle line allows the block to move quickly rearward, greatly reducing the vertical lifting advantage, and now light drag retaining forces make more possible the smooth acceleration into the dump mode.

It provides much lighter forces necessary to hold the tilt back control against its stops, that makes the pendulous swing to vertical suspension and beyond, a more nearly true rhythm and much easier to transition into a smooth rapid rotation to dump, It can reasonably be called a pendulous rhythm, because only minimum transition restraining forces are required.

It provides simplicity that was intended to be incorporated into the design of the total structure with many cross uses of components.

It provides graduated inward forces of bridle chains, relative to their load or work to offset the spreading forces at their hitch points.

It provides the cross uses that have increased the strength of the bucket that not only eliminates considerable structural weight, but whole pieces, as the arch, or the upper support.

It provides a great forward reclining C shaped span from one drag hitch, lip end cutter, lip, opposite lip end cutter, and drag hitch, instead of going directly as a face down D arch or upper support, a heavier less tolerant system of former buckets.

It provides a great rim which departing one lip end cutter now travels up the front, rearward on the side and across the back, and forward on the opposite side to the upper front and then descending to the opposite lip end cutter.

It provides this long span that doubles as a supper long rim, invisible arch, and has something former buckets have not enough, ample strength with an abundance of tolerance.

It provide this super long, tolerant, invisible arch which acts as the uppser rim of the bucket, giving it excellent strength, and it is itself, greatly strengthened by preloading with earth pressure of the inflatable sides and rear of the basket.

It provides a basket that is of Herculean strength, but built of a silk stocking.

It provide sides that are constructed of thin, effective steel thickness which incorporate a flange break, widen out and preload under the earth load inflating process.

It provides sides with effective width moments, offering a strength to weight ratio, unlike anything offered by former buckets, and they serve multiple duties.

It provides the structure of these rear corners that vector stress to form the invisible arch of the strong and light shape and still serve as the rim at the top of the basket.

It provides a structure from minimal material that gives carrying and wear support to the wear area at the back and the bottom of the basket, generous in size and cost effective.

It provides this new potential for the bucket to reach up to 110% of vertical suspension while using a near pendulous swing.

It provides a bucket that will save energy for other efforts, and work approximately 66% of the time for the same production.

It provides a bucket that will produce up to 150% for as little as 90% of the horse power under similar conditions as former buckets.

It provides a bucket for an old dragline equipped with the new art bucket that can produce up to 50% more.

It provides a bucket that total operating and man power costs and exposure costs can be as little as 66%.

It provides a structural innovative bucket with light draft, cavernous size, and capable of using pendulous suspension swing, incorporated with a precise tilt back control.

It can further provide that same bucket incorporating simultaneous direct trajectory and long reach with production up to 150% of former buckets.

This bucket can provide renewing of the dragline operator glow with safety, and efficiency.

It have provided the anatomy and the physiology of this new art, the low draft high yield bucket system for draglines.

While my above description contains many specificities, these should not be construed as limitations on the scope of the invention, but rather, as examples of several preferred embodiments. The bucket system can be applied to front end loaders, shovels, backhoes, scrapers and dredge buckets.

Thus, the scope of the invention should be determined not by the embodiments illustrated, but by the appended claims and their legal equivalents.

I claim:

1. A low draft, high yield bucket system comprising: a bucket being polygon in shape having;

an open front, a leading ground engaging edge having a lip, a plurality of lip end cutters, and means of reinforcing said lip and;

a basket having a bottom surface wherein the bottom surface defines a horizontal plane, upper and lower back surfaces joined at a first flange break and first and second opposed sides, each said first and second opposed sides including upper and lower side surfaces;

the lower side surfaces having a wall angle ranging from 20 to 60 degrees as defined by a first angle between one of the lower side surfaces and a vertical plane, the upper and lower side surfaces defining first and second planes respectively and joined forming a corresponding aligning second flange break wherein the upper side surfaces slope in a first direction from said vertical plane with respect to the second flange break at the upper and lower back surfaces and in a second direction from said vertical plane at said open front;

said first and second planes defining an angle ranging from approximately 120 to 160 degrees;

teeth mounted to a front of said lip at a mount angle and tilted downwardly at a tilt angle;

wherein said lip end cutters are flared outwardly at a flare angle ranging from 8 to 20 degrees with respect to the vertical plane;

drag lines operatively connected to a forward portion of said lip end cutters, dump lines operatively connected to an upper front portion of said upper sides, wherein said drag and dump lines are constructed with a dump line stop operatively opposing a dump block stop, hoist lines operatively connected to a rearward portion of said lower sides wherein said dump lines are constructed and arranged to provide precise tilt back carry and to dump said bucket.

2. The low draft, high yield bucket system of claim 1 wherein said mount angle of the teeth is of the range from 20 to 70 degrees with respect to the horizontal plane.

3. The low draft, high yield bucket system of claim 1 wherein said tilt angle of the teeth is of the range from 8 to 20 degrees below the horizontal plane.

* * * * *